United States Patent [19]

Shaw

[11] 4,274,337

[45] Jun. 23, 1981

[54] MODEL LOCOMOTIVES

[75] Inventor: Christopher W. Shaw, Kirkbymoorside, England

[73] Assignee: Micro Metalsmiths Limited, North Yorkshire, England

[21] Appl. No.: 53,730

[22] Filed: Jul. 2, 1979

[30] Foreign Application Priority Data

Jul. 5, 1978 [GB] United Kingdom ..... 28959/78

[51] Int. Cl.[3] ..... B61C 9/30; B61C 15/14; B61F 3/04

[52] U.S. Cl. ..... 105/99; 105/1 T

[58] Field of Search ..... 104/DIG. 1; 105/29 TL, 105/99, 1 T; 238/10 E, 10 F

[56] References Cited

U.S. PATENT DOCUMENTS

| | | | |
|---|---|---|---|
| 1,499,870 | 7/1924 | Pickering | 105/99 |
| 2,708,888 | 5/1955 | Varney | 105/99 |
| 3,369,500 | 2/1968 | Rossi | 105/99 |
| 3,859,927 | 1/1975 | Pelabon | 105/99 |

FOREIGN PATENT DOCUMENTS

| | | | |
|---|---|---|---|
| 510494 | 8/1939 | United Kingdom | 105/99 |
| 841659 | 7/1960 | United Kingdom | 105/99 |
| 888940 | 2/1962 | United Kingdom | 105/99 |
| 893768 | 4/1962 | United Kingdom | 105/99 |
| 941045 | 11/1963 | United Kingdom | 105/99 |

*Primary Examiner*—Richard A. Bertsch
*Attorney, Agent, or Firm*—Brisebois & Kruger

[57] ABSTRACT

In a model of a steam locomotive having two independent sets of driving wheels, the single electric motor for driving the model is coupled to the two sets of driving wheels via a differential gear. The latter allows the two sets of driving wheels to alter their angular positions relative to each other, owing to track irregularities and other causes, and thereby enables the model to operate more realistically.

6 Claims, 1 Drawing Figure

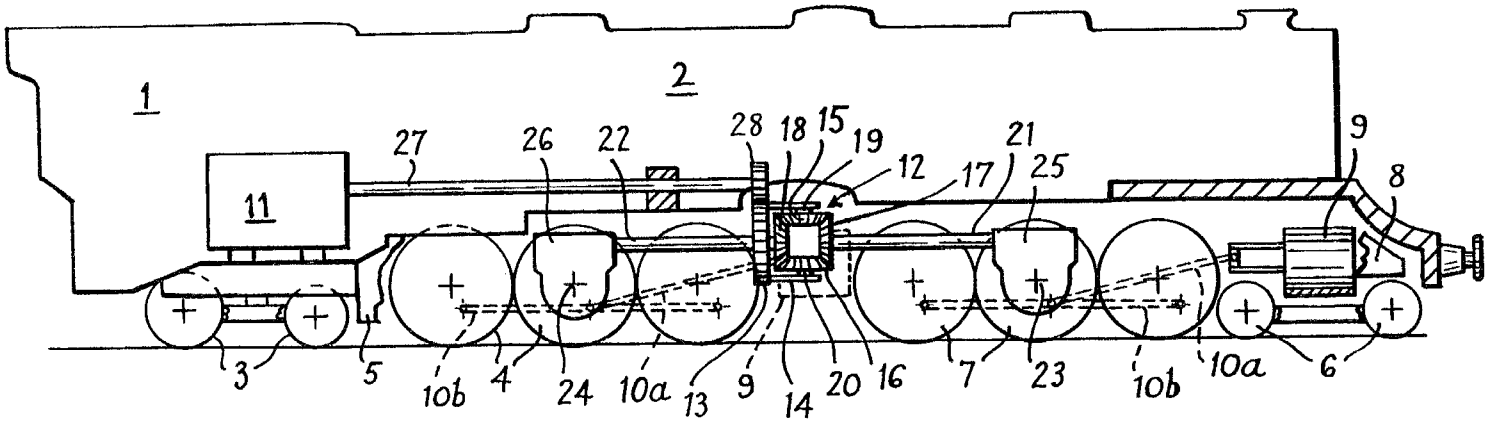
1
2
3
4
5
6
7
8
9
10a
10b
11
12
13
14
15
16
17
18
19
20
21
22
23
24
25
26
27
28

MODEL LOCOMOTIVES

BACKGROUND OF THE INVENTION

The present invention relates to model locomotives or railway engines and, more particularly, to scale model steam locomotives.

Some steam locomotives which are reproduced as models had two independent sets of steam cylinders and driving wheels. In some cases, such locomotives were articulated so that they could more easily negotiate curves, whereas others were provided with two sets of cylinders and driving wheels mounted in a rigid frame. An example of the articulated construction was the Union Pacific 4-8-8-4 heavy freight locomotive, known as the "Big Boy". An example of the rigid construction was the Pennsylvania Railroad 4-4-4-4 heavy passenger locomotive known as a "duplex" type.

In both constructions, the real locomotives had no connection between the two sets of cylinders and driving wheels, save that in some cases the locomotives were arranged so that steam was compounded, being used first in one set of cylinders and then in the other. However, in neither construction were the two sets of driving wheels mechanically coupled together so that the wheels of one set were permanently linked in a predetermined angular configuration to the wheels of the other set. This meant that the wheels of one set would, in fact, alter their angular position with respect to the wheels of the other set owing to track irregularities, the propensity of one or other set of wheels to slip, etc.

Models of the above types of locomotives have often been produced with a single electric motor driving both sets of driving wheels through appropriate shafts and gearing. With this arrangement, there is no capability for the wheels of one set of assume a different angular position with respect to the wheels of the other set, other than through back-lash and play in the gears and couplings, which is negligible. In another arrangement, it has been proposed to use two electric motors, one for each individual set of driving wheels, so that the wheels of each set are able to assume different angular positions from time to time.

SUMMARY OF THE INVENTION

It is an object of the present invention to provide a model of a locomotive of the type comprising two independent sets of driving wheels, in which a single electric motor installed in the model is connected to the two sets of driving wheels by a drive coupling which enables the sets of wheels to alter their angular positions relative to one another, thereby producing more realistic operation.

To this end, the invention consists in a model of such a locomotive, including an electric drive motor coupled to the two sets of driving wheels via a differential gear. The motor drive shaft is coupled to the input gear wheel of the differential, whilst the output gear wheels thereof are connected, respectively, to the two sets of driving wheels. For example, each of the output gear wheels may be connected to its associated set of driving wheels by a shaft which is coupled by a gearbox to the axle of one of the pairs of driving wheels. The effect of the differential is to permit slippage of one set of driving wheels relative to the other as a result of track irregularities and other slippage causes, generally.

The aforementioned and other objects and advantages of the invention will be apparent from the following description, the accompanying drawing and the appended claims.

BRIEF DESCRIPTION OF THE DRAWING

The single FIGURE schematically illustrates a longitudinal section through a model of an articulated locomotive embodying the invention. Parts of the sectional view are cut away in order more clearly to illustrate the details of the invention.

DESCRIPTION OF PREFERRED EMBODIMENT

The locomotive illustrated in the drawing has a 4-6-6-4 wheel arrangement with the front set of driving wheels and front bogie being articulated to the main frame of the locomotive. It comprises a cab 1, a boiler 2, a rear bogie 3 and set of driving wheels 4 mounted on the main frame 5 of the locomotive and a front bogie 6 and set of driving wheels 7 mounted on an auxiliary frame 8 articulated to the main frame 5 in any suitable manner. The model also includes model drive mechanism and control gear conforming to that of the real locomotive and generally illustrated in the drawing by steam cylinders 9 and driving and connecting rods **10*a*, 10*b***.

The model is driven by a single electric motor 11 installed at the cab-end of the locomotive, within the cab and the adjacent part of the boiler. This motor is connected to the two sets of driving wheels 4,7 via a differential gear 12 mounted below the boiler and between the two sets of driving wheels. The differential gear may be concealed from view in the mounting construction of the rear steam cylinders 9 and comprises an input or a crown wheel 13 which is loosely mounted on the output shaft 22 and is fixed to a box 14 in which four differential gear wheels 15–18 are mounted. The differential pinions 15,16 have shafts 19,20 rotatably mounted in the box 14 whilst the output gear wheels 17,18 are fixed to the inner ends of output shafts 21,22 extending fore and aft of the model locomotive. The shaft 21 extends towards the axle 23 of the middle pair of the front set of driving wheels 7 and the shaft 22 projects towards the axle 24 of the middle pair of the rear set of driving wheels 4. They are coupled to these axles 23,24 by gearboxes 25,26, which may comprise worms and worm wheels or crossed helical gears or bevel gears, using, where necessary, universal or other types of flexible joint. Such gearboxes will not be described in detail herein as they may be of any convenient construction and do not form part of the present invention.

The electric motor 11 is connected to the crown wheel 13 of the differential via a propeller shaft 27 mounted in a fore and aft position within the boiler 2 of the model. This propeller shaft is connected at one end to the drive shaft of the motor and has its opposite end coupled to the crown wheel 13 by a pinion 28 fixed to the end of the propeller shaft. The pinion 28 and crown wheel 13 provide a speed reduction between the electric motor and the driving wheels which, for practical purposes, is generally necessary.

As a result of the differential gear 12 coupling the electric drive motor 11 to the two sets of driving wheels 4,7, the latter can alter their angular positions with respect to one another, as occurs in a real locomotive of this type, by reason of track irregularities and other causes.

While a particular embodiment has been described, it will be understood that the invention is not limited to the precise form of apparatus described and that changes may be made therein without departing from the scope of the invention. For example, when required, the speed-reducing gear mechanism between the electric drive motor and the driving wheels may be of any convenient design. Moreover, in an alternative construction, it may be disposed on the output side of the differential instead of its input side. Furthermore, whilst in the preferred embodiment the drive motor 11 has its drive shaft coupled to the differential gear 12 by a propeller shaft and reduction gear mechanism, the motor drive shaft may alternatively be coupled to the differential gear by a belt or chain drive, for example, connecting a suitable wheel on the motor drive shaft to the input wheel of the differential gear.

I claim:

1. In a model of a steam locomotive which has two independent front and rear sets of driving wheels, each set of driving wheels of said model including a plurality of pairs of driving wheels interconnecting by axles, connecting rods interconnecting the individual pairs of driving wheels in each said set, and a single electric motor coupled to axles of both sets of driving wheels for driving said model, the improvement comprising means for permitting relative rotation between the wheels of each said set with respect to the wheels of the other said set and comprising differential gear means including an input wheel and two output gears, output shafts connected to said output gears and extending towards said two sets of driving wheels, respectively, gearbox means coupling each of said output shafts to the axle of one pair of said driving wheels of the associated set, and means coupling said electric motor to said input wheel of said differential gear means, whereby the wheels of each said set can drift in and out of synchronisation with the wheels of the other said set to provide for more realistic operation of the model steam locomotive.

2. The improvement claimed in claim 1, wherein said differential gear means is disposed in a position between said two sets of driving wheels and said output shafts extend generally fore and aft of said model.

3. The improvement claimed in claim 1, including a propeller shaft mounted generally fore and aft within said model and adapted to be driven by said electric motor, and gear means coupling said propeller shaft to the input gear of said differential gear means.

4. The improvement claimed in claim 3, wherein said coupling gear means and said input gear constitute a reduction gear means.

5. The improvement claimed in claim 4, wherein said coupling gear means comprises a pinion fixed to said propeller shaft and meshing with said input gear of said differential gear means.

6. The improvement claimed in claim 1, wherein each set of said driving wheels comprises three pairs of driving wheels, said rear set of driving wheels is mounted on the main frame of said model, said front set of driving wheels is mounted on an auxiliary frame articulated to said main frame, said electric motor is mounted within the body of said model at the cab end thereof, said differential gear means is mounted below the boiler of said model in a position between said sets of driving wheels, said output shafts are fastened respectively to said output gears of said differential gear means and extend fore and aft of said model from said differential gear means towards the axles of the middle pair of said driving wheels of each said set, respectively, said gearbox means couples said output shafts to said axles of said middle pair of driving wheels, a propeller shaft extends fore and aft of said model within the boiler thereof and is connected at one end to said motor, and a pinion is fixed to said propeller shaft at the opposite end thereof and meshes with said input gear of said differential gear means, said pinion and input gear constituting a reduction gear means.

* * * * *